US007275789B2

(12) United States Patent
LaPointe

(10) Patent No.: US 7,275,789 B2
(45) Date of Patent: Oct. 2, 2007

(54) ROCKER SPRING ASSEMBLY

(75) Inventor: Larry P LaPointe, Temperance, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 142 days.

(21) Appl. No.: 11/243,085

(22) Filed: Oct. 4, 2005

(65) Prior Publication Data

US 2007/0085395 A1 Apr. 19, 2007

(51) Int. Cl.
*A47C 3/02* (2006.01)
*A47C 3/027* (2006.01)

(52) U.S. Cl. ..... 297/258.1; 297/259.2; 297/264.1; 297/267.1

(58) Field of Classification Search ..... 297/258.1, 297/259.2, 264.1, 267.1, 271.4
See application file for complete search history.

(56) References Cited

U.S. PATENT DOCUMENTS

| | | | |
|---|---|---|---|
| 203,602 | A | 5/1878 | Dietsch |
| 488,911 | A | 12/1892 | Weber |
| 3,042,448 | A | 7/1962 | Hamilton |
| 3,295,885 | A | 1/1967 | Barksdale |
| 4,367,895 | A | 1/1983 | Pacitti et al. |
| 4,437,701 | A | 3/1984 | Mizelle |
| 4,810,032 | A | 3/1989 | Gibson |
| 5,104,181 | A | 4/1992 | Lange |
| 5,121,966 | A | 6/1992 | Tischler |
| 5,171,000 | A | 12/1992 | LaPointe et al. |
| 5,301,413 | A | 4/1994 | Habegger et al. |
| 5,370,442 | A | 12/1994 | Saul et al. |
| 5,567,009 | A | 10/1996 | Fay et al. |
| 5,582,459 | A | 12/1996 | Hama et al. |
| 5,738,409 | A | 4/1998 | Bursik |

OTHER PUBLICATIONS

International Search Report regarding corresponding International Application No. PCT/US2006/38366.
International Search Report dated Apr. 25, 2007, 4 pages.

*Primary Examiner*—Rodney B. White
(74) *Attorney, Agent, or Firm*—Harness, Dickey & Pierce, P.L.C.

(57) ABSTRACT

A furniture member such as a rocking chair includes a chair frame operable for rocking motion relative to a stationary base. The chair frame and stationary base are coupled together by a rocker spring assembly positioned on each side of the frame/base. The rocker spring assembly includes upper and lower brackets and a single coiled spring connected to both brackets. A displacement limiting device is positioned within an inner cavity of the coiled spring to limit the rocking movement of the chair frame.

24 Claims, 6 Drawing Sheets

ROCKER SPRING ASSEMBLY

FIELD OF THE INVENTION

The present invention relates in general to rocking chairs and more specifically to a rocker spring assembly to couple a rocker block and a stationary base of a rocking chair together.

BACKGROUND OF THE INVENTION

Rocking and reclining chairs commonly include some form of spring mechanism between their base portions and lower structure of the chair itself to enable the chair to rock freely in forward and rearward movements. Rocking and reclining chairs have been known to generate disturbing noise as the springs are extended and compressed. Rocking-type chairs commonly provide a two-spring rocker spring assembly between the stationary base and lower structure of the chair frame for biasing the chair in an upright, neutral position while enabling the chair to rock forwardly and rearwardly. As a seat occupant rocks, the chair follows the contour of a rocker block disposed on the chair frame and supported by the stationary base. As the chair is rocked forwardly and rearwardly, the individual springs of the two spring set of the rocker spring assembly positioned on each side of the chair are alternately extended and compressed. This extension and compression of multiple springs can cause them to generate undesirable spring noise.

A second source of noise may occur when the rocking chair is rocked too far forward or rearward such that the moveable chair frame contacts the stationary base, a nearby wall, or the floor causing a knocking or bumping sound. Such motion of the chair frame relative to the base can also create an unbalanced condition for the chair or create a situation where objects may be trapped or compressed between the chair frame and the base or the floor as the chair is rocked. To help alleviate this condition, U.S. Pat. No. 5,567,009 to Fay et al., commonly assigned to the assignee of the present invention and incorporated herein by reference, discloses limit rods positioned at outside ends of a double-spring rocker spring assembly which function to limit the displacement of both springs.

The Fay et al. design is successful in limiting displacement of the two spring rocker spring assembly and therefore in reducing the knocking or bumping sounds of the second source described above. The Fay et al. design also successfully provides for sound suppression of the two-spring rocker spring assembly relative to the first source, but further improvement in sound suppression of the noise generated by alternate compression and expansion of the pairs of springs is warranted, as well as reduction in the assembly costs.

SUMMARY OF THE INVENTION

According to one embodiment of the invention, a rocker spring assembly for a rocking furniture member includes a first bracket and a second bracket arranged in opposed relationship to the first bracket. A single biasing element connects the first and second brackets. The biasing element includes an open inner cavity. A displacement limiting device is disposed within the inner cavity of the biasing element. The displacement limiting device includes a shaft having opposed ends, and a bulbous head created at each of the opposed ends. The shaft is movably received within an aperture in each of the first and second brackets. The displacement limiting device limits a total displacement of the first and second brackets when the bulbous heads contact the first and second brackets.

According to other embodiments, a rocking furniture member includes a base, and a chair frame supported on the base for rocking movement relative to the base, the chair frame including first and second side members. A first rocker spring assembly directly couples the first side member and the base. A second rocker spring assembly directly couples the second side member and the base. Each of the first and second rocker spring assemblies includes a first bracket secured to the chair frame, a second bracket secured to the base, and a single biasing element disposed between and secured to the upper and lower brackets for biasing the chair frame in an upright, neutral position and for enabling a furniture member occupant to rock forwardly and rearwardly.

According to still other embodiments, a rocking/reclining chair having a rocker spring assembly of the present invention further includes a leg rest assembly disposed within and suspended from the chair frame. The leg rest assembly is positionable between a retracted position and an extended position. In yet still other embodiments, a method for controlling a rocking motion of a rocking chair is provided.

A rocker spring assembly of the present invention provides several advantages. A single helically coiled spring used in place of two coiled springs of known designs reduces operating noise and assembly costs. A single displacement limiting device positioned within the through cavity of the single coiled spring does not interfere with spring travel at the outer spring envelope, and does not interfere with chair components. Use of a single displacement limiting device permits the spring total deflection to be adjusted both in a front/back rocking direction and in a total spring elongation direction, thus limiting the total rocking motion of the chair or component.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

The following description of several embodiments of the present invention is merely exemplary in nature and is in no way intended to limit the invention, its application, or uses.

Figure 1:
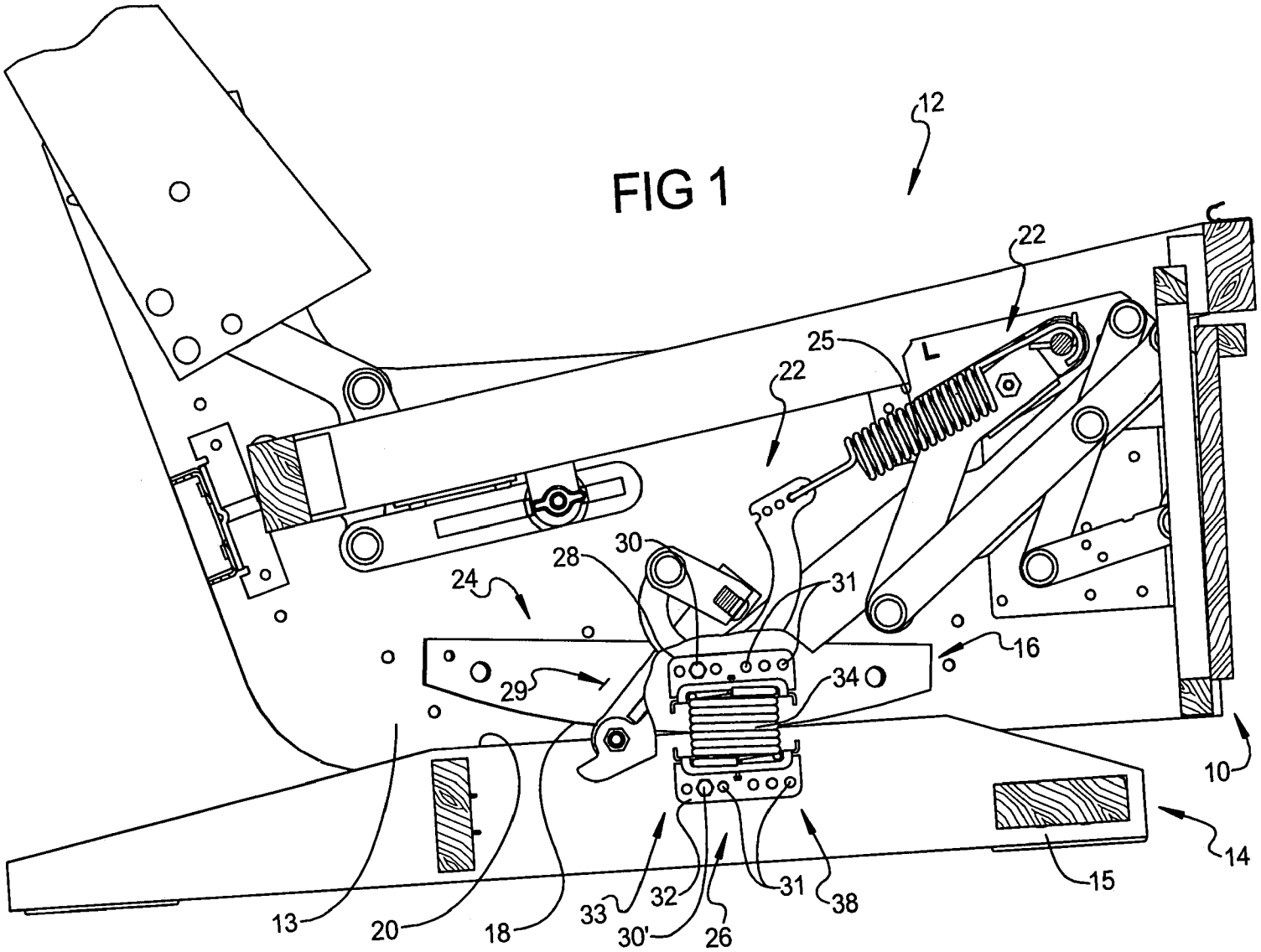
FIG. 1 is a cross-sectional view of a rocking chair taken along a lateral axis of the chair illustrating the chair frame, rocker block, stationary base, and rocker spring assembly of the present invention, and a leg rest assembly also shown in phantom.

Referring to FIG. 1, a portion of a rocking/reclining chair 10, including a chair frame 12 having a side portion 13 and a stationary base 14 which can include foot portions 15 is illustrated. A rocker block 16, made for example from wood, is attached to side portion 13 of chair frame 12 and includes a rocking surface 18 which abuts an upper surface 20 of stationary base 14 to enable chair frame 12 to rock relative to stationary base 14. The rocking path of chair frame 12 is partially defined by the contour of rocking surface 18. While the present invention is described with reference to a wooden rocker block, one skilled in the art will appreciate that the present invention could employ other types of rocker blocks without deviating from the scope of the present invention. For example, a polymeric material rocker block, such as that disclosed in U.S. Pat. No. 5,370,442 to Saul et al. and commonly assigned to the Assignee of the present invention, could be readily adapted into the present invention.

Rocking/reclining chair 10 further includes a leg rest assembly 22 and an actuation mechanism 24 (only partially shown) for providing a leg rest assembly which is positionable from a retracted, stowed position to a protracted, extended position. Actuation mechanism 24 and leg rest assembly 22 often include biasing elements 25 for assisting in the operation of the reclining features of chair 10. U.S. Pat. No. 5,301,413 entitled "Modular Reclining Chair and Method of Making" which issued Apr. 12, 1994 provides a more detailed description of the biasing elements and operation of leg rest assembly 22 and actuation mechanism 24. This reference is commonly owned by the Assignee of the present invention and is expressly incorporated by reference herein.

A pair (right and left hand) of rocker spring assemblies 26 (only one is shown in FIG. 1) are laterally located on a right and a left hand side of chair 10 for coupling chair frame 12 to base 14. Because right and left rocker spring assemblies 26 are duplicates of each other, only the details of one will be described hereinafter.

Figure 2:
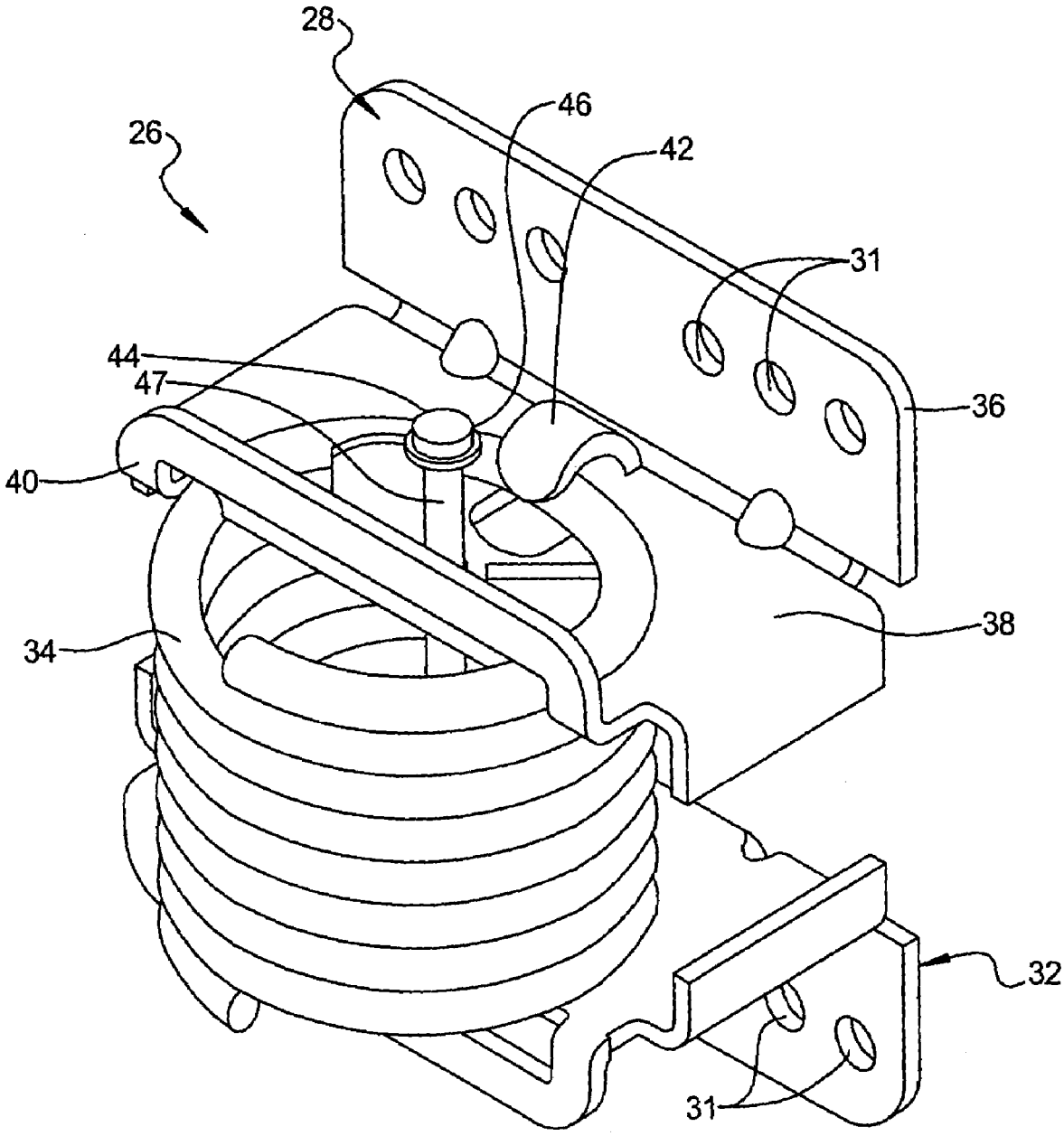
FIG. 2 is front perspective view of a rocker spring assembly in accordance with the present invention.

Referring now to both FIGS. 1 and 2, each rocker spring assembly 26 includes a first bracket 28 secured to a side portion 29 of rocker block 16 with a plurality of fasteners 30 disposed through selected ones of a plurality of apertures 31 created in first bracket 28. Each rocker spring assembly 26 also includes a second bracket 32 similarly secured to a side portion 33 of stationary base 14 with fasteners 30' inserted through selected ones of apertures 31 created in second bracket 32. A single biasing element 34 is disposed between and attached to first bracket 28 and second bracket 32 for biasing chair frame 12 to an upright, neutral position. In some embodiments, biasing element 34 is a single wire helically coiled spring transversely positioned relative to first and second brackets 28, 32.

First and second brackets 28, 32 are substantially identical to each other and are oriented in opposed relationship as shown to receive biasing element 34. Each of first and second brackets 28, 32 include a first bracket portion 36 which includes apertures 31, and a second bracket portion 38 also having apertures 31. Biasing element 34 is connected to both first and second brackets 28, 32. A stiffening member 40 spans a substantially semi-spherical aperture in second bracket portion 38 and stiffens second bracket portion 38 where the semi-spherical aperture is located. A hook-shaped member 42 overlaps a portion of biasing element 34 to retain biasing element 34. A single displacement limiting device 44 is positioned within an open central aperture of biasing element 34. Displacement limiting device 44 includes opposed bulbous ends 46, 48 (only bulbous end 46 is visible in this view). Displacement limiting device is movably received within a bracket aperture 47 of second bracket portion 38 and a similar bracket aperture (not visible) in second bracket portion 38 of second bracket 32.

When assembled, a tensioning force or preload of rocker spring assembly 26 can be varied to provide an increased or decreased biasing effect from biasing element 34 in a forward and/or rearward rocking direction of chair 10. To accomplish this, the relative alignment of apertures 31 of the first bracket 28 can be vertically and/or horizontally modified from corresponding ones of the apertures 31 of the second bracket 32 to vary the preload of biasing element 34 compared to a preload of a nominal aperture alignment. The relative position of apertures 31 of the first bracket 28 can be also be angled or canted with respect to the relative position of corresponding ones of the apertures 31 of the second bracket 32.

Figure 3:
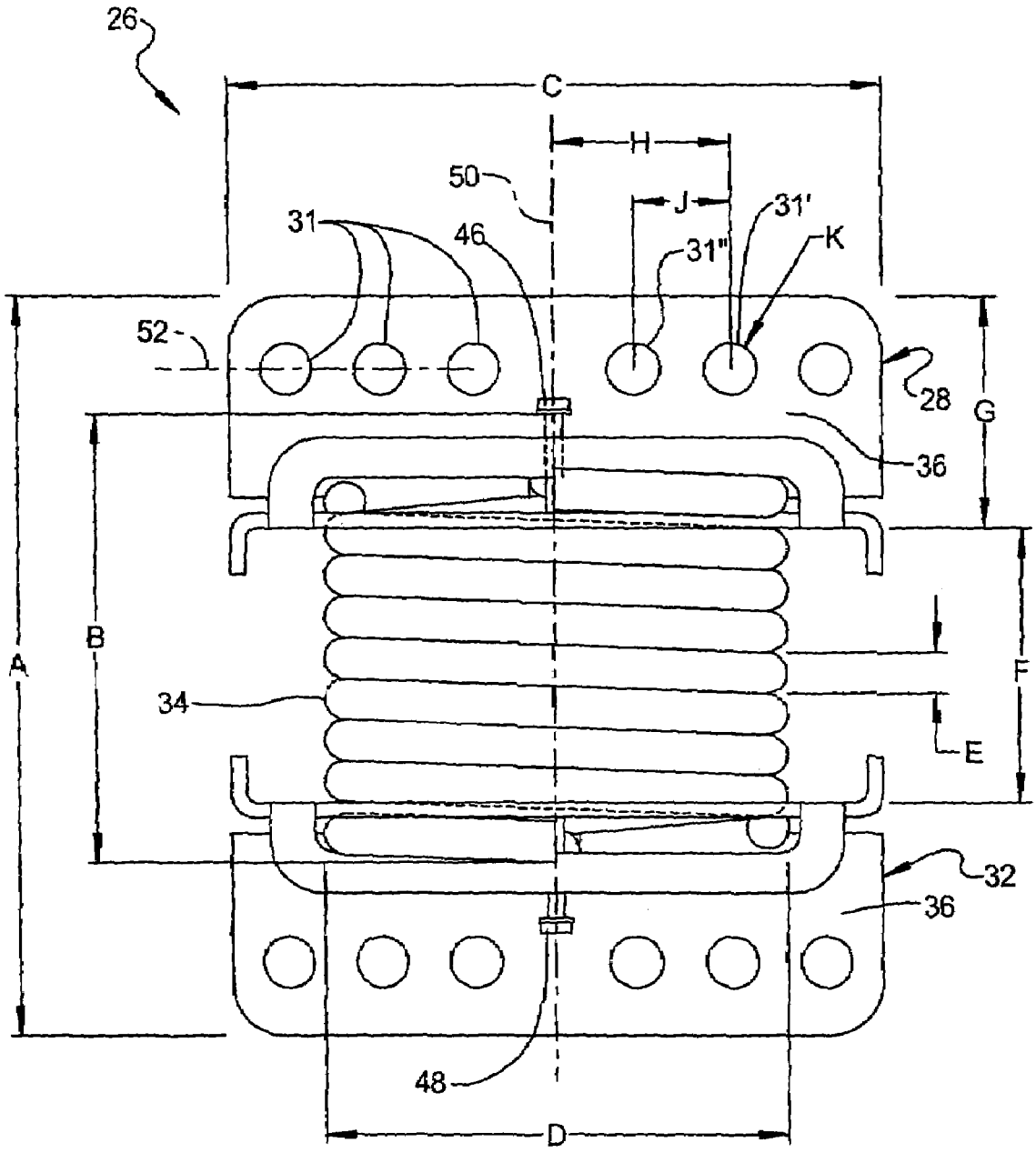
FIG. 3 is a front elevational view of the rocker spring assembly of FIG. 2.

Referring next to FIG. 3, further details of rocker spring assembly 26 are shown. An assembly total height "A" is in part determined by a total length "B" of biasing element 34. A total assembly width "C" is in part determined by a diameter "D" of biasing element 34. Biasing element 34 includes a wire diameter "E" and a working length "F" between second bracket portions 38 of first and second brackets 28, 32. A bracket height "G" provides sufficient material to create each of apertures 31. Apertures 31 can be spaced, for example, from a longitudinal axis 50. In the example shown, aperture 31' is spaced from a longitudinal axis 50 by a distance "H" which in one embodiment equals 0.750 in. (1.905 cm). Apertures 31 can also be spaced relative to each other. For example apertures 31' and 31" are spaced from each other by a dimension "J" which in one embodiment equals 0.375 in. (0.952 cm). Each of apertures 31 of a particular bracket are aligned on a common centerline 52 and include a common diameter "K", which in one embodiment equals 0.219 in. (0.556 mm).

Figure 4:
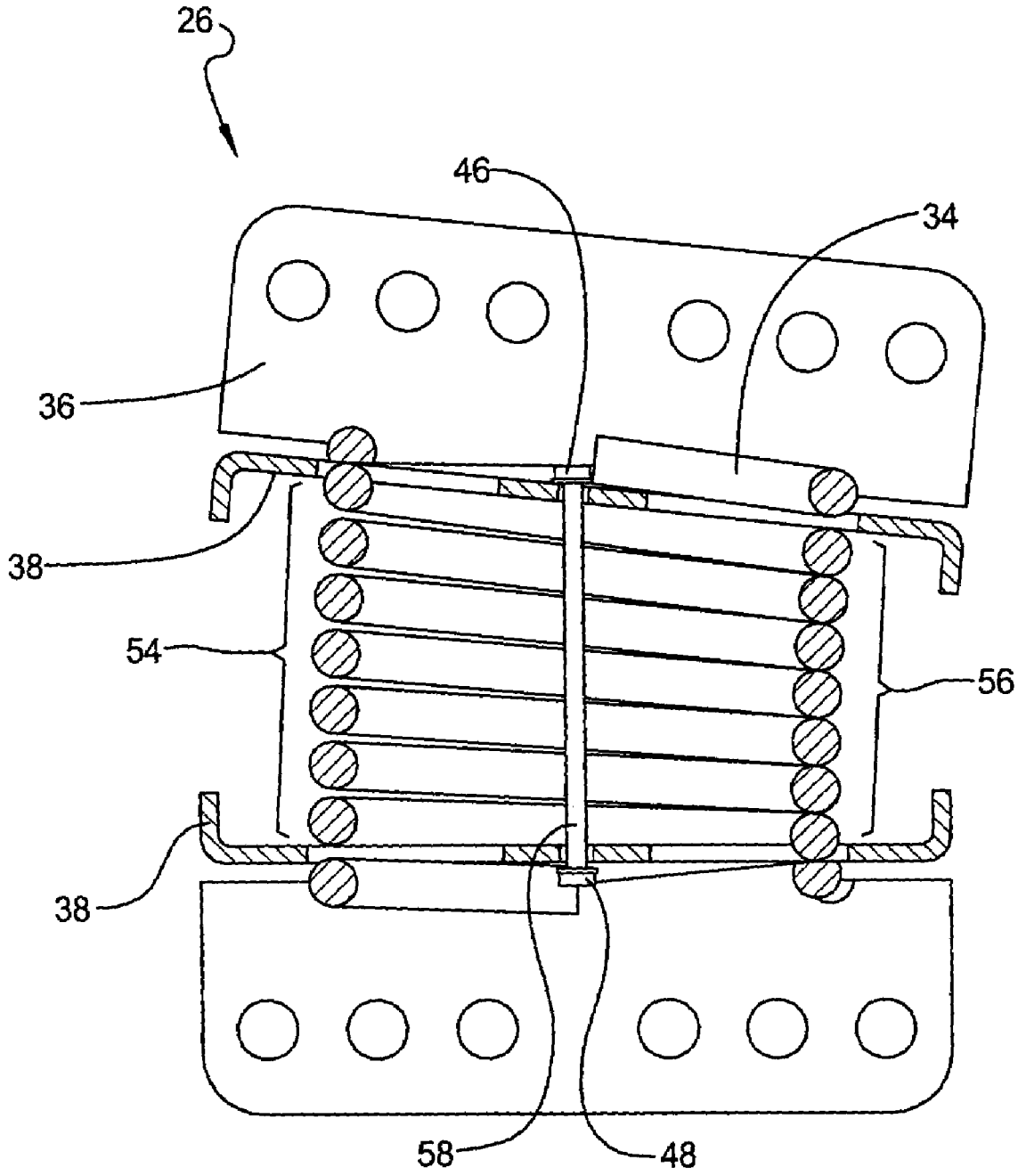
FIG. 4 is an front sectional view of the rocker spring assembly taken at section 4-4 of FIG. 5 showing a biasing element in a deflected position when the chair frame is rocked relative to the stationary base.

Referring now to FIG. 4, as chair frame 12 is rocked either forward or rearward relative to stationary base 14, first bracket 28 translates and rotates relative to second bracket 32, causing biasing element 34 to bend relative to longitudinal axis 50. As biasing element 34 deflects or bends in response to the rocking motion, a first portion 54 extends and a second portion 56 contracts, creating stored energy in biasing element 34. Most of the stored energy created by this bending motion acts to urge chair frame 12 back to its upright, neutral position. This enables a seat occupant to enjoy rocking movement when desired while allowing chair 10 to return to its conventional orientation when not in use. Some of the stored energy imparted to a coil spring upon bending thereof can also generate unwanted noise upon bending or upon return to the non-deflected position. This noise is reduced by the design of the present invention, in part by the use of only a single coil spring in place of the traditional two coil spring designs of contemporary rocker spring assemblies.

With continuing reference to FIG. 4, displacement limiting device 44 provides bulbous ends 46, 48 which function in part to limit the rocking movement of chair frame 12 relative to stationary base 14. Displacement limiting device 44 helps prevent chair frame 12 from contacting base 14, a nearby wall, or the floor and generating an undesired knocking sound. Displacement limiting device 44 also functions to prevent an unbalanced condition of chair 10 or creation of a situation where objects may be trapped or compressed between chair frame 12 and base 14 or the floor as the chair is rocked. Displacement limiting device 44 provides a positive stop to prevent forward tipping of chair 10 when a seat occupant lifts his or her legs off of the floor or exits chair 10.

The positive stop feature of displacement limiting device 44 cooperates with first bracket 28 and second bracket 32 to define a range of rocking movement. Displacement limiting device 44 includes a shaft 58 having first and second bulbous ends 46, 48 disposed at each end thereof. Shaft 58 extends through bracket aperture 47 created in first bracket 28 and a bracket aperture 60 (not visible in this view) created in second bracket 32. Bracket apertures 47, 60 are oversized to allow first bracket 28 to rotate and translate freely relative to second bracket 32 during rocking movement without binding of shaft 58. First and second bulbous ends 46, 48 are substantially larger than bracket apertures 47, 60 for engaging first and second brackets 28, 32 to limit the relative movement of first bracket 28 relative to second bracket 32. First and second bulbous ends 46, 48 further act to prevent shaft 58 from becoming disconnected with first bracket 28 and/or second bracket 32. In some embodiments, first and second bulbous ends 46, 48 are formed by flaring end portions of shaft 58 perpendicular to first and second brackets 28, 32. In other embodiments, at least one of first and second bulbous ends 46, 48 is formed in a stamping operation subsequent to the attachment of biasing element 34 to first bracket 28 and second bracket 32.

Figure 5:
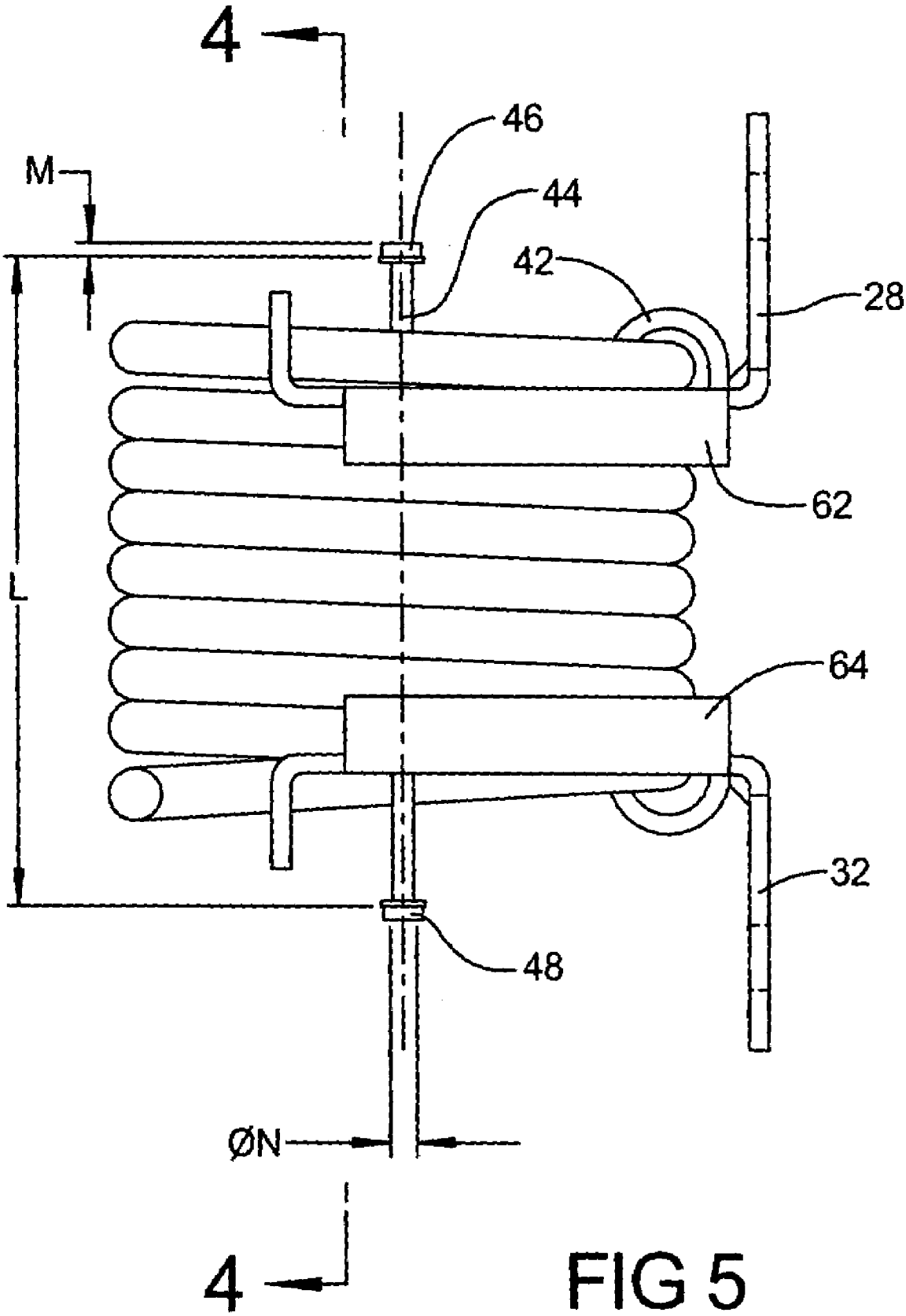
FIG. 5 is a side elevational view of the rocker spring assembly of FIG. 3.

With reference to FIG. 5, a length "L" of shaft 58 between first and second bulbous ends 46, 48 predetermines the range of rocking movement enabled. A total depth "M" and a total height "N" of each of bulbous ends 46, 48 provide retention capability to prevent further rocking movement and structural strength to prevent pullout of shaft 58. Each of first and second brackets 28, 32 further include an opposed pair of formed walls 62, 64 which further stiffen first and second brackets 28, 32.

Figure 6:
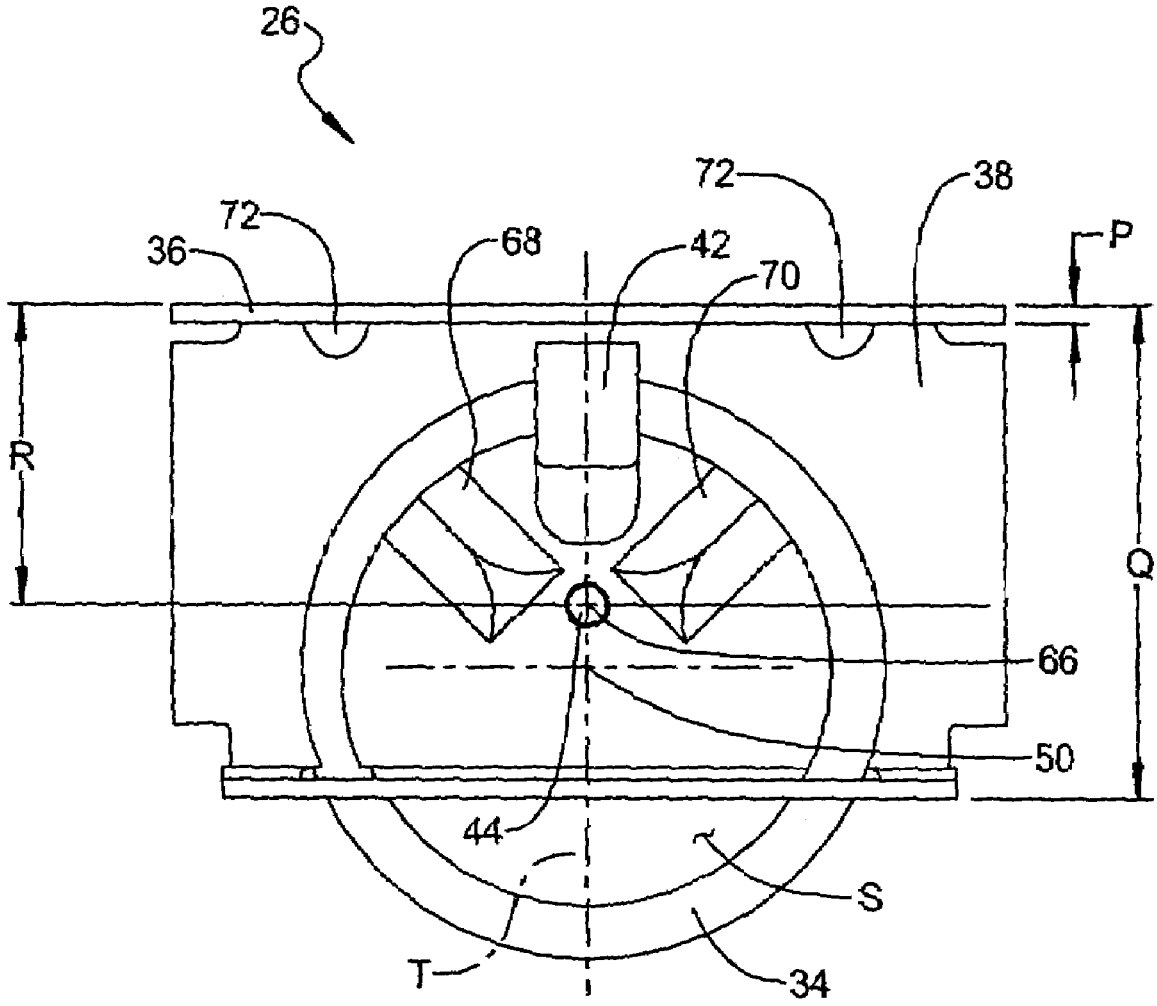
FIG. 6 is a top plan view of the rocker spring assembly of FIG. 3.

As best seen in reference to FIG. 6, each of the first bracket portions 36 have a thickness "P", which in one embodiment equals 0.075 in. (0.190 cm). Rocker spring assembly 26 includes an overall depth "Q" which in one embodiment equals 1.431 in. (3.635 cm). In at least one embodiment, a longitudinal axis 66 of displacement limiting device 44 is offset or displaced toward first bracket portion 36 relative to longitudinal axis 50 and positioned within an inner clearance area "S" of biasing element 34. This placement of displacement limiting device 44 permits deflection of biasing element 34 to either side. When positioned as shown having longitudinal axis 66 in a common plane "T" with longitudinal axis 50, the present invention provides substantially equal limits for forward and rearward rocking movement.

First and second raised elements 68, 70 can also be positioned on an inner diameter side of biasing element 34 which cooperate with hook-shaped member 42 to retain biasing element 34 in contact with second bracket portions 38 of rocker spring assembly 26. First and second raised elements 68, 70 are created in one embodiment in a stamping operation for second bracket portions 38. Reinforcement or embossed elements 72 can also be provided at the junction between first and second bracket portions 36, 38 to locally stiffen the assembly. Biasing element 34 can be reverse oriented (ie.: the upper end as shown can be rotated and positioned where the lower end is shown) without modification of the operating characteristics of rocker spring assembly 26. This advantageously prevents incorrect assembly of biasing element 34 compared to some common rocker spring assemblies having two biasing elements which require "handed" biasing element installation.

In further embodiments, rocking chair 10 may be capable of greater rearward (or forward) rocking movement before the chair frame contacts the base or floor than forward rocking movements. Accordingly, in other embodiments, shaft 58 of displacement limiting device 44 can also be positioned offset or "off-center" (ie:, to the left or right as viewed in FIG. 6) relative to plane "T" and longitudinal axis 50 of biasing element 34, to permit greater rearward (or forward) rocking movement. One skilled in the art would readily recognize that the length of shaft 58 is partially determined by the contour of rocker block 16, the balance of chair 10, and the range of rocking movement, and hence the special relationship between chair frame 12, base 14, the wall and the floor.

Stationary base 14 of rocking chair 10 permits chair frame 12 to be swivelled or rotated about a vertical axis. The position of shaft 58 within biasing element 34 helps prevent interference with portions of stationary base 14 as chair frame 12 swivels. Rocker spring assembly 26 therefore provides clearance between chair frame 12 and stationary base 14.

A rocker spring assembly of the present invention provides several advantages. A single helically coiled spring used in place of two coiled springs of known designs reduces operating noise and assembly costs. A single displacement limiting device positioned within the through cavity of the single coiled spring does not interfere with spring travel at the outer spring envelope, and does not interfere with chair components. Use of a single displacement limiting device permits the spring total deflection to be adjusted both in a front/back rocking direction and in a total spring elongation direction, thus limiting the total rocking motion of the chair or component.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A rocker spring assembly for a rocking furniture member, comprising:

a first bracket;

a second bracket arranged in opposed relationship to the first bracket;

a single coil spring connected between the first and second brackets, the coil spring including an open inner cavity; and a single displacement limiting device disposed through the inner cavity of the coil spring, the displacement limiting device including:

a shaft having opposed ends; and a bulbous head created at each of the opposed ends;

wherein the shaft is movably received within an aperture in each of the first and second brackets, the displacement limiting device being operable to limit a total displacement between the first and second brackets when the bulbous heads contact the first and second brackets.

2. The rocker spring assembly of claim 1, wherein each of the first and second brackets further comprise a first bracket portion and a second bracket portion, the second bracket portion operable to connectably receive the coil spring.

3. The rocker spring assembly of claim 2, further comprising a hook-shaped member extending from the second bracket portion and engageable with the coil spring.

4. A rocker spring assembly for a rocking furniture member, comprising:

a first bracket;

a second bracket arranged in opposed relationship to the first bracket;

a biasing element connected between the first and second brackets, the biasing element including an open inner cavity;

each of the first and second brackets further include a first bracket portion and a second bracket portion, the second bracket portion operable to connectably receive the biasing element;

a displacement limiting device disposed through the inner cavity of the biasing element, the displacement limiting device including:

a shaft having opposed ends; and a bulbous head created at each of the opposed ends;

a hook-shaped member extending from the second bracket portion and engageable with the biasing element; and at least one raised element created on the second bracket portion and oriented with respect to the hook-shaped member to positively engage the biasing element between the hook-shaped member and the raised element;

wherein the shaft is movably received within an aperture in each of the first and second brackets, the displacement limiting device being operable to limit a total displacement between the first and second brackets when the bulbous heads contact the first and second brackets.

5. The rocker spring assembly of claim 1, wherein each of the first and second brackets further comprise a plurality of alignment apertures.

6. The rocker spring assembly of claim 1, wherein the second bracket comprises a duplicate of the first bracket.

7. The rocker spring assembly of claim 1, wherein the coil spring is reversibly positionable between the first and second brackets.

8. The rocker spring assembly of claim 1, wherein a longitudinal axis of the displacement limiting device is offset from a coil spring longitudinal axis.

9. A rocking furniture member, comprising:

a base;

a chair frame supported on the base for rocking movement relative to the base, the chair frame including first and second side members;

a first rocker spring assembly directly coupling the first side member and the base;

a second rocker spring assembly directly coupling the second side member and the base;

each of the first and second rocker spring assemblies including:

a first bracket secured to the chair frame;

a second bracket secured to the base; and a single coil spring disposed between and secured to the upper and lower brackets for biasing the chair frame in an upright, neutral position and for enabling a furniture member occupant to rock forwardly and rearwardly.

10. The rocking furniture member of claim 9, further comprising a limit device disposed through an inner cavity of the coil spring.

11. The rocking furniture member of claim 10, wherein the limit device further comprises:

a shaft portion; and a stop member disposed at each end of the shaft portion;

wherein the first and second brackets each include an aperture formed therethrough for receiving the shaft portion of the limit device, the stop members being engageable with the first and second brackets to define a range of rocking movement of the furniture member.

12. The rocking furniture member of claim 11, comprising a size of the aperture formed in the first and second brackets operable to allow the first bracket to freely rotate and translate relative to the second bracket as the furniture member is rocked within the range of rocking movement.

13. The rocking furniture member of claim 10, comprising a predetermined length of the limit device selectable to limit a total displacement of the coil spring.

14. The rocking furniture member of claim 10, comprising a position of the limit device within the inner cavity operable to divide the range of rocking movement substantially equally between a forward and a backward rocking movement.

15. The rocking furniture member of claim 10, comprising a position of the limit device within the inner cavity operable to unequally divide the range of rocking movement between a forward and a backward rocking movement.

16. A rocking/reclining chair, comprising:

a base;

a chair frame supported on the base for rocking movement relative to the base;

a rocker spring assembly coupling the base and the chair frame, the rocker spring assembly including:

a first bracket secured to the chair frame;

a second bracket secured to the base;

a single coil spring disposed between and secured to the first and second brackets for biasing the chair frame in an upright, neutral position and for enabling an occupant to rock forwardly and rearwardly; and a limit member disposed between the first and second brackets and within a cavity of the single coil spring, the limit member having a shaft portion and a stop member disposed at each end of the shaft portion, the limit member being operable to limit a total displacement of the rocker spring assembly; and a leg rest assembly disposed within and suspended from the chair frame, the leg rest assembly positionable between a retracted position and an extended position.

17. The rocking/reclining chair of claim 16, further comprising an aperture formed through the first and second brackets for receiving the shaft portion of the limit member, the stop members being engageable with the first and second brackets to define a range of rocking movement.

18. The rocking chair of claim 17, wherein the apertures created in the first and second brackets are sized to allow the first bracket to freely rotate and translate relative to the second bracket as the chair is rocked within the range of rocking movement.

19. A method for controlling a rocking motion of a rocking chair, the chair having a base, a chair frame supported from the base and a rocker spring assembly connecting the base to the chair frame, the rocker spring assembly having first and second brackets, the method comprising:

interconnecting the first and second brackets with a single coil spring to bias the chair frame in an upright, neutral position and to enable a seat occupant to rock forwardly and rearwardly;

slidably interposing a displacement limiting device between the first and second brackets and within a cavity of the single coil spring; and creating radially extending opposed ends of the displacement limiting device engageable with the upper and lower brackets operable to limit a range of rocking movement of the rocking chair.

20. The method of claim 19, further comprising creating apertures in both the first and second brackets to movably receive the displacement limiting device.

21. The method of claim 19, further comprising:

attaching the first bracket of the rocker spring assembly to the chair frame; and connecting the second bracket of the rocker spring assembly to the base.

22. The method of claim 19, further comprising extending a hook-shaped element from the rocker spring assembly operable to mechanically engage the single coil spring.

23. A method for controlling a rocking motion of a rocking chair, the chair having a base, a chair frame supported from the base and a rocker spring assembly connecting the base to the chair frame, the rocker spring assembly having first and second brackets, the first bracket having a first plurality of fastener receiving apertures and the second bracket having a second plurality of fastener receiving apertures, the method comprising:

interconnecting the first and second brackets with a single coil spring to bias the chair frame in an upright, neutral position and to enable a seat occupant to rock forwardly and rearwardly;

slidably interposing a displacement limiting device between the first and second brackets and within a cavity of the single coil spring; and varying a preload of the single coil spring by changing a relative position between the first and second sets of fastener receiving apertures.

24. The method of claim 23, further comprising creating radially extending opposed ends of the displacement limiting device engageable with the upper and lower brackets and operable to limit a range of rocking movement of the rocking chair.

* * * * *